United States Patent [19]

Abraham

[11] Patent Number: 5,040,382

[45] Date of Patent: Aug. 20, 1991

[54] REFRIGERANT RECOVERY SYSTEM

[75] Inventor: Anthony W. Abraham, Arlington, Tex.

[73] Assignee: 501 Wynn's Climate Systems, Inc., Ft. Worth, Tex.

[21] Appl. No.: 540,186

[22] Filed: Jun. 19, 1990

[51] Int. Cl.[5] ..... F25B 43/02

[52] U.S. Cl. ..... 62/470; 62/77; 62/85; 62/149; 62/292; 62/472; 62/475

[58] Field of Search ..... 62/468, 470, 472, 475, 62/292, 149, 85, 77

[56] References Cited

U.S. PATENT DOCUMENTS

| | | | |
|---|---|---|---|
| 2,971,352 | 2/1961 | Parker | 62/475 |
| 2,986,905 | 6/1961 | Kocher et al. | 62/475 |
| 3,004,396 | 10/1961 | Endress et al. | 62/472 X |
| 3,620,038 | 11/1971 | Muench | 62/475 X |
| 3,688,515 | 9/1972 | Lavigne, Jr. | 62/475 X |
| 3,705,499 | 12/1972 | Mount et al. | 62/472 X |
| 4,285,206 | 8/1981 | Koser | 62/149 X |
| 4,363,222 | 12/1982 | Cain | 62/292 |
| 4,441,330 | 4/1984 | Lower et al. | 62/149 |
| 4,476,688 | 10/1984 | Goddard | 62/85 |
| 4,766,733 | 8/1988 | Scuderi | 62/77 |
| 4,776,175 | 10/1988 | Romijn | 62/85 |
| 4,809,520 | 3/1989 | Manz et al. | 62/292 |
| 4,862,699 | 9/1989 | Lounis | 62/84 |
| 4,878,356 | 11/1989 | Punches et al. | 62/149 |
| 4,887,435 | 12/1989 | Anderson, Jr. | 62/475 X |
| 4,903,499 | 2/1990 | Merritt | 62/77 |

*Primary Examiner*—Lloyd L. King
*Attorney, Agent, or Firm*—James E. Bradley

[57] ABSTRACT

A refrigerant recovery apparatus has features for trapping oil recovered from an air conditioning system. It has a low pressure oil separator which is mounted in line with the flow of refrigerant on the suction side of the compressor. The low pressure oil separator will be located at a lower elevation than the compressor. When the compressor is turned off, this allows excess oil in the compressor to drain to its design level.

8 Claims, 2 Drawing Sheets

REFRIGERANT RECOVERY SYSTEM

BACKGROUND OF THE INVENTION

1. Field of the Invention

This invention relates in general to equipment for removing refrigerant fluid from refrigerated air systems, cleaning the fluid and storing it for later use.

2. Description of the Prior Art

Many refrigerated air systems, such as air conditioning systems, utilize chloroflurocarbons (CFC's) as the refrigerant. Scientists believe that the release of CFC's into the atmosphere tends to destroy the ozone layer in the earth's stratosphere. Environmental concerns and governmental regulations dictate that as little as possible of CFC's be released into the atmosphere.

When performing maintenance on refrigerant systems, often the refrigerant fluid must be removed. In the past, repairmen would vent the gases to the atmosphere. Now, manufacturers market equipment to recover the refrigerant rather than vent it to the atmosphere.

The prior art refrigerant recovery equipment has an inlet for connection to the air conditioning system for receiving refrigerant. An expansion valve expands any liquid refrigerant to gas. A compressor will compress the gas, which then flows to a compressor. A condenser condenses the gas to a liquid, and stores it in a storage container for later use. The equipment has filters for filtering metal particles and other impurities as the refrigerant flows through the recovery equipment. The equipment has a recycle mode to recycle the refrigerant from the storage container back through the recovery equipment for further filtering.

Air conditioning systems utilize a compressor which requires oil. While recovering the refrigerant, some of the oil will be drawn out into the recovery system. The recovery equipment has a low pressure oil trap or separator on the suction side of the recovery equipment compressor for trapping the oil drawn in from the air conditioning system. The amount of oil recovered will be measured. This amount of oil will be re-introduced into the air conditioning system when repaired to assure that the compressor operates with the proper amount of oil.

The compressor of the recovery equipment also has a compressor that requires oil. Some of this oil will be released as a mist into the high pressure gas flowing from the compressor. A high pressure oil trap locates on the discharge side of the compressor. The high pressure oil trap separates oil from the refrigerant gas. It has an oil line that leads back to into the compressor suction. A float allows the compressor to draw oil back in when the level in the high pressure oil trap exceeds a minimum.

Normally, some of the oil mist in the regrigerant gas being recovered will flow past the low pressure oil separator. This oil will be drawn into the compressor. This may result in the recovery system compressor operating on more oil than it needs. Some of the excess oil will be discharged out the high pressure side of the compressor. However, this excess oil will be trapped by the high pressure oil trap and drawn back through the oil line into the compressor.

Excess oil can be damaging to the compressor. When the compressor is off, there is no way for any excess oil to drain out of the compressor if the high pressure oil trap valve is closed.

SUMMARY OF THE INVENTION

In this invention, a low pressure oil separator is located on the suction side of the compressor. This oil separator traps most of the oil in the refrigerant flowing to the compressor as well as accumulating liquid refrigerant. It has an outlet positioned at the top of the separator so as to prevent oil from flowing out of the low pressure separator. The outlet of the low pressure oil separator is located at an elevation below the suction inlet of the compressor. Consequently, when the compressor is turned off, any excess oil in the compressor above the suction inlet will drain back into the oil separator.

The system also has a conventional high pressure oil separator mounted on the discharge side of the compressor in line with the flow of refrigerant. As the refrigerant flows through the high pressure oil separator, any oil in the line will drop out and accumulate in the high pressure oil separator. An oil line extends from the high pressure oil separator to a suction inlet in the suction chamber of the recovery apparatus compressor. A valve allows the compressor to withdraw oil from the high pressure oil separator when the level in the high pressure oil separator exceeds a set level.

The two oil separators have heaters to heat the oil in cold weather. The heaters enable the oil to remain at a temperature adequate for flow. These heaters will turn on only when the head pressure of the compressor drops below a selected minimum.

DETAILED DESCRIPTION OF THE INVENTION

Figure 1:
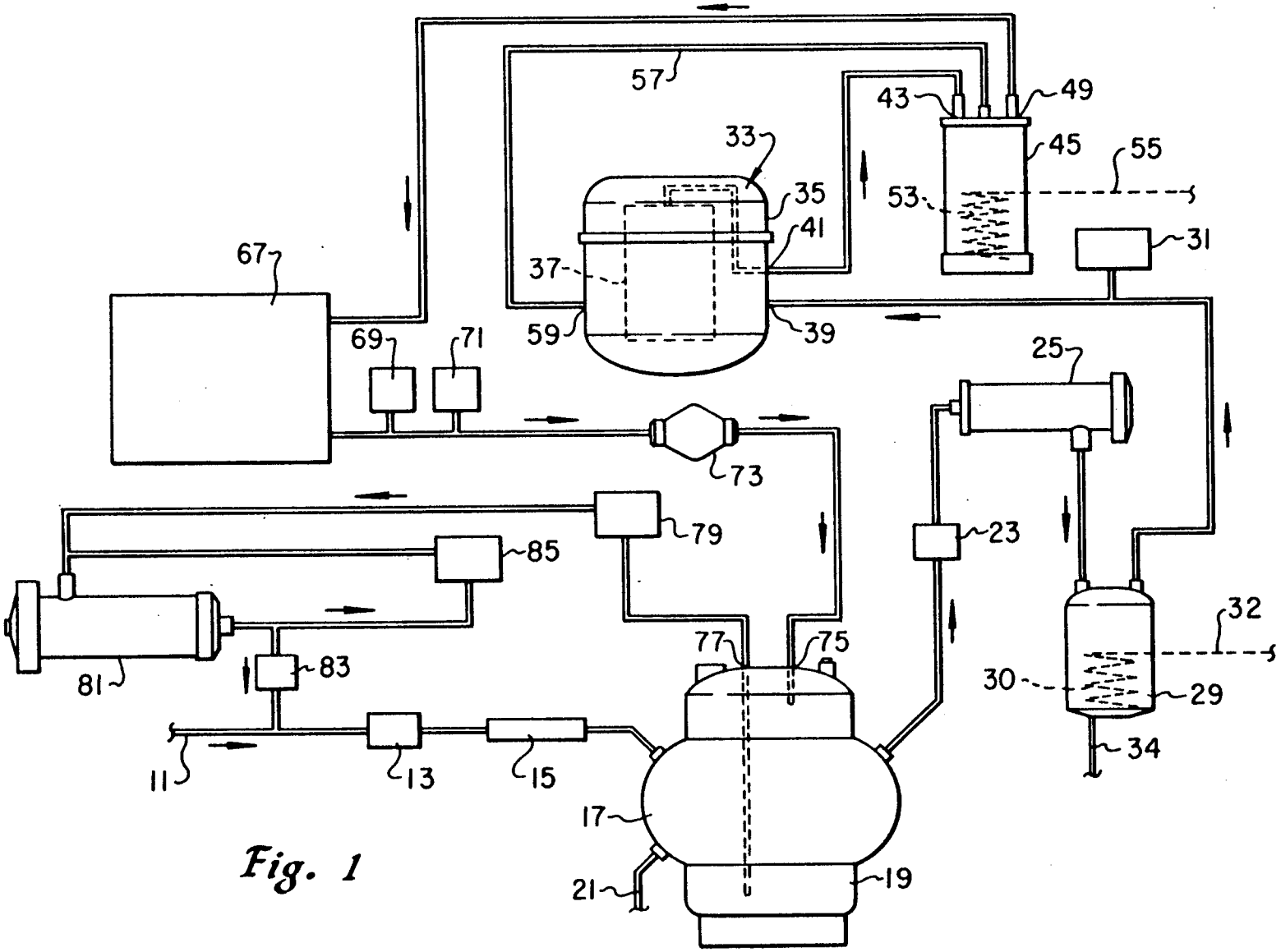
FIG. 1 is a schematic diagram illustrating a recovery apparatus constructed in accordance with this invention.

Referring to FIG. 1, liquid inlet 11 is adapted to be connected to a refrigeration system for recovering the refrigerant. It will be connected between the condenser and expansion valve in the air conditioning system. Consequently, most of the refrigerant entering the liquid inlet 11 will be a liquid, although it may be mixed with gas to some extent.

The refrigerant flows through a filter 13 and expansion valve 15 into a jacket 17. Jacket 17 is an annular rigid member that encircles a storage chamber 19. The refrigerant within the jacket 17 will be primarily a gas because it has proceeded through expansion valve 15, which through reduction in pressure converts the liquid refrigerant to a gas. The refrigerant within the jacket 17 will be warmed by heat exchange with liquid refrigerant stored in the storage chamber 19. A drain tube 21 will enable any oil collecting in the jacket 17 to be drained. The oil will be oil recovered from the air conditioning system.

The gaseous refrigerant will be drawn by suction from the jacket 17 through a check valve 23 and to a strainer 25. The check valve 25 prevents any back flow into the jacket 17. Strainer 25 serves to remove metal particles and other impurities in the refrigerant.

Figure 2:
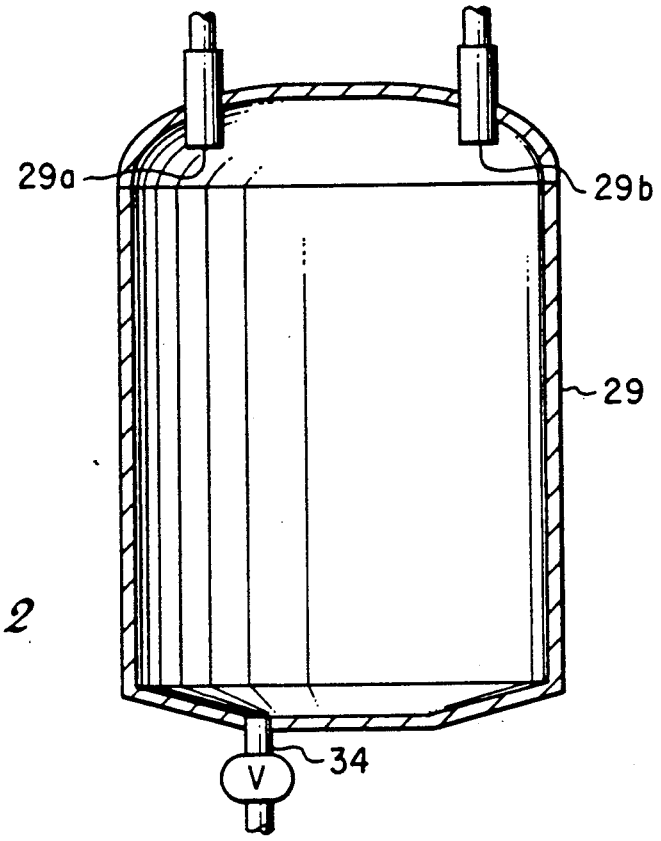
FIG. 2 is a schematic representation of the low pressure oil separator used with the apparatus of FIG. 1.

From strainer 25, the refrigerant flows into a low pressure oil separator or trap 29. The low pressure oil separator 29 serves to trap oil contained in the refrigerant gas. Also, it will trap any liquid refrigerant. As shown also in FIG. 2, the low pressure oil separator 29 is a cylindrical housing or container. It has a top with an inlet 29*a* and an outlet 29*b*. The lower ends of the inlet 29*a* and the outlet 29*b* are substantially at the top. Consequently, oil collecting in the low pressure oil separator 29 will not easily flow out the outlet 29*b*. Some oil may flow out the outlet 29*b* in the form of a mist within the flow of gaseous refrigerant. Any liquid refrigerant accumulating in the oil separator 29 will boil off due to the low pressure and flow out the outlet 29*b* eventually.

Referring again to FIG. 1, the oil separator 29 has an electrical resistance heater 30 which will be mounted to it for heating any oil trapped in the oil separator 29. The heater 30 is an electrical resistance strip mounted to the exterior of the oil separator 29. An electrical wire 32 supplies power to the heater 30. A drain 34 enables the oil separator 29 to be drained after each use. The drain 34 has a manual valve as indicated schematically in FIG. 2.

The refrigerant gas flows from the low pressure oil separator 29 into a compressor 33. Compressor 33 will be of conventional design. It has a housing 35 containing a pump 37 which is a piston reciprocally driven in a cylinder. The housing 35 will be at a negative or suction pressure. Oil will be contained in the lower portion of the housing 35 for lubricating the pump 37. The suction inlet 39, which connects to the low pressure oil separator 29, is simply a port cut into the sidewall of the housing 35.

Suction inlet 39 is located a selected distance above the bottom of the housing 35. This position defines a reservoir in the housing 35 below the suction inlet 39 for oil to accumulate. The position of suction inlet 39 is selected to provide a desired amount of oil needed to operate the compressor 33. The low pressure oil separator 29 will be placed at a lower elevation than the compressor 33. The low pressure oil separator outlet 29*b* will be at a lower elevation than the compressor inlet 39. When the compressor 33 is not operating, any oil in the housing 35 above the inlet 39 will drain by gravity through the outlet 29*b* into the low pressure oil separator 29. The drainage will cease once the level of oil in the housing 35 drops below the inlet 39.

Refrigerant gas flows into the housing 35, which comprises a suction chamber, and from there it is pumped by the pump 37 out a discharge outlet 41. The gas at an elevated pressure and temperature will flow out the discharge outlet 41 and into an inlet 43 of a high pressure oil separator 45. The high pressure oil separator 45 is conventional and is shown also in FIG. 3. It comprises a cylindrical container. A filter 47 mounts to the inlet 43, which is in the top of the oil separator 45. The outlet 49 is also in the top of the oil separator 45. Its lower end is located substantially at the top so as to prevent any liquid from flowing out the outlet 49.

A heater coil 53, shown in FIG. 1, will heat the oil in cold weather conditions to assure that it will drain. An electrical wire 55 supplies power to the heater coil 53. Heater coil 53 is a strip mounted to the exterior of oil separator 45.

Oil separator 45 also has an oil line 57 that extends from its top to a suction inlet 59 in the compressor 33. The suction inlet 59 will simply be a port in the sidewall of the compressor housing 35. Consequently, it will be at negative pressure while the pump 37 operates.

Referring again to FIG. 3, the lower end of the oil line 57 extends a substantial distance into the oil separator 45. A seat 61 is located in the lower end of the oil line 57. A needle valve 63 opens and closes the seat 61. A float 65 connects to the needle valve 63 by a hinge pin and also to the oil line 57. When the float 65 moves upward, the needle 63 will move downward, opening the seat 61. When the level of oil in the separator 45 drops, the float 65 will drop, eventually causing the needle 63 to engage the seat 61. Prior to operating the compressor 33, the oil separator 45 will be filled with oil to a selected level. At the selected level, the seat 61 will not yet be open. It will need to fill to a higher level by oil entrapment before the float 65 causes the needle 63 to open the seat 61.

When the compressor 33 operates, a lower pressure at the suction inlet 59 than in the oil separator 45 will cause the oil to flow up the oil line 57 to the compressor 33 if the seat 61 is open. If the level of oil has dropped so that the float 65 has closed the seat 61 with needle 63, then oil cannot flow up the oil line 57.

Referring again to FIG. 1, the gaseous refrigerant in oil separator 45 flows out the outlet 49 to a conventional condenser 67. Condenser 67 will be cooled by a fan (not shown). The high pressure hot gas will condense to a high pressure cooler liquid. The outlet of the condenser 67 will be monitored by a high pressure valve 69 and a low pressure valve 71. The high pressure valve 69 will cut off the compressor 33 if the pressure reaches a dangerously high level at the outlet of condenser 67. The low pressure valve 71 will control the fan of the condenser 67 and also the heater strips 30 and 53. If the pressure at the outlet of the condenser 67 is low enough, then the low pressure switch 71 will supply energy to the wires 32 and 55 to begin heating the oil and to turn off the fan. Low pressure is an indication of low atmosphere temperatures.

The refrigerant flows out the outlet of the condenser 67 through a conventional moisture indicator 73. Indicator 73 monitors the liquid content of the refrigerant to determine if additional recycling is needed. The refrigerant flows then into an inlet 75 of the storage chamber 19. An outlet 77 extends down to the lower portion of the storage chamber 19. Outlet 77 will be used for recycling the refrigerant for further cleaning. The outlet 77 will be opened by a solenoid valve 79 if selected by the operator.

The refrigerant will flow through the valve 79 to a filter and dryer 81. Additional impurities will be removed from the refrigerant at this point. The refrigerant flows out the filter 81 through a check valve 83 into the inlet 11. The refrigerant will circulate through the system in the same manner as previously described. A pressure gage 85 monitors the pressure drop across the filter 81 to determine when changing is necessary.

In operation, the operator will connect the inlet 11 to the air conditioning system to begin withdrawing refrigerant. If inlet 11 is used, the refrigerant will flow through the filter 13 and through an expansion valve 15 to jacket 17. Expansion valve 15 will drop the pressure, converting the liquid refrigerant into a gas in the jacket 17. The warmer liquid refrigerant stored in the storage chamber 19 warms the gas to prevent freezing.

The gaseous refrigerant flows through check valve 23 and strainer 25 into low pressure oil separator 29. Most of the oil in the refrigerant will be removed at this point. Some oil in a mist, however, flows with the refrigerant out the outlet 29*b*. The refrigerant flows into suction inlet 39 of compressor 33. Some of the oil in the mist will commingle with lubricating oil contained in the housing 35 of compressor 33.

Compressor 33 pressurizes the gaseous refrigerant and discharges it out discharge outlet 41 to high pressure oil separator 45. Some of the oil contained in the compressor 33 will be discharged out outlet 41 in an oil mist. Oil contained in the refrigerant gas will be collected in the oil separator 45. The gaseous refrigerant will flow out the outlet 49 to condenser 67.

Figure 3:
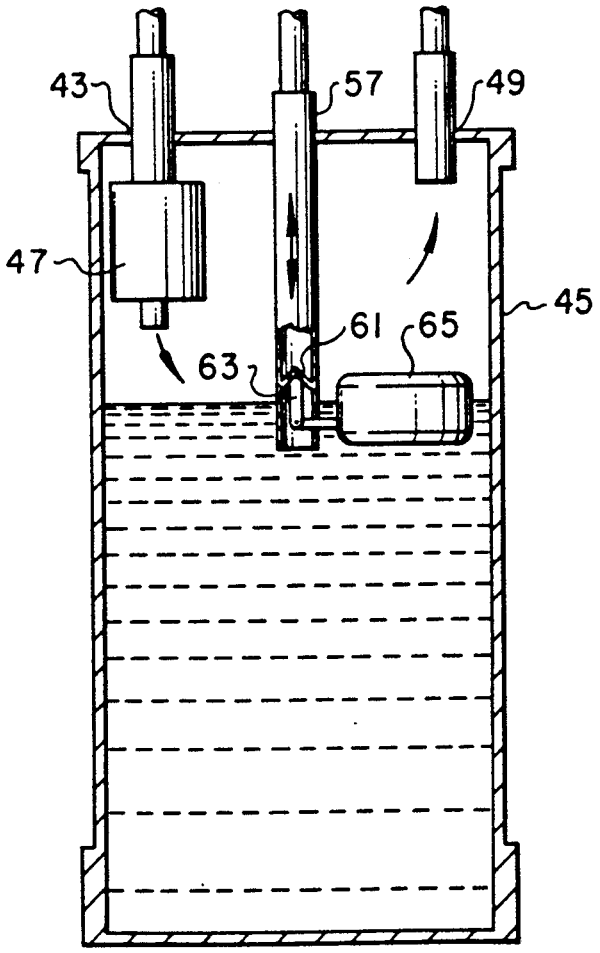
FIG. 3 is a schematic representation of the high pressure oil separator used with the recovery apparatus of FIG. 1.

Referring to FIG. 3, if the oil collected in the oil separator 45 has reached a high enough level, the float valve 65 will open the seat 61. This indicates that oil discharged from compressor 33 has been collected in the oil separator 45. The compressor 33 will draw the oil back in the oil line 57 into the suction inlet 59. Once the oil level drops in the oil separator 45, the float 65 will close the seat 61, preventing any additional oil from being drawn into the compressor 33.

The high pressure refrigerant gas will be condensed into a liquid by the condenser 67 and flow into the storage chamber 19. If the operator wishes to recycle the refrigerant for additional cleaning, he actuates the solenoid valve 79. This causes the stored refrigerant liquid in the storage chamber 19 to flow out through the valve 79, through the filter 81, and back into the inlet 11. This refrigerant then circulates through the recovery apparatus in the previously mentioned manner.

Once the refrigerant is cleansed sufficiently, the compressor 33 will be turned off. When the compressor 33 shuts down, it is possible that the oil level in the housing 35 will be above design level. This occurs as a result of recovered oil flowing out of the low pressure oil separator 29 as a mist and commingling with the oil in the housing 35. The design level will be flush with the suction inlet 39. If the level of oil is above this amount, the excess oil will flow by gravity down through outlet 29*b* into the low pressure oil separator 29.

Drains 34 and 21 will be opened to collect all of the air conditioning system oil recovered. This amount is measured as it indicates the amount withdrawn from the air conditioning system. Once the air conditioning system is repaired, this amount of oil has to be introduced back into the air conditioning system if the same compressor is used. This assures that the air conditioning system has the proper amount of lubricating oil.

After draining from drains 21 and 34, the only oil remaining in the recovery apparatus will be the oil in the housing 35, and the oil in the high pressure oil separator 45. The level in the high pressure oil separator 45 will be the at the initial charging level, which is the level that causes the float 65 to close the seat 61. The oil in the compressor housing 35 will be at its design level.

The invention has significant advantages. The location of the locating of the oil separator outlet at a lower elevation than the suction inlet of the compressor allows drainage of excess oil back into the low pressure oil separator. This assures that the compressor will not be overfilled for the next operation. The heaters, and the control of the heaters by the head pressure conveniently assures that the oil can easily flow in cold weather.

While the invention has been shown in only one of its forms, it should be apparent to those skilled in the art that it is not so limited, but is susceptible to various changes without departing from the scope of the invention.

I claim:

1. In a refrigerant recovery apparatus of the type having inlet means for connecting to a refrigerant air system to withdraw refrigerant from the system, expansion means for converting refrigerant received from the system in liquid phase to a gaseous refrigerant, a compressor having a suction chamber with a suction inlet for receiving and pressurizing the gaseous refrigerant, the compressor having a housing containing oil for lubricating the compressor, a condenser for receiving the pressurized gaseous refrigerant and condensing it to liquid refrigerant, and a storage chamber for storing the liquid refrigerant, the improvement comprising in combination:

oil separator means mounted exterior of the housing to one end of an inlet line, which has another end connected to the suction inlet of the compressor for receiving the flow of refrigerant from the refrigerated air system for separating out oil mixed with the refrigerant being received from the refrigerated air system prior to the refrigerant entering the suction inlet of the compressor; and the oil separator means being mounted at a lower elevation than the suction inlet of the compressor, the inlet line being unrestricted for allowing refrigerant flow to the compressor and oil form the compressor for draining oil in the housing of the compressor above the suction inlet back though the inlet line into the oil separator means when the compressor is not operating.

2. The apparatus according to claim 1 wherein the oil separator means includes a container having an upper end with an inlet and an outlet, the outlet being connected to the inlet line that extends to the suction inlet of the compressor.

3. The apparatus according to claim 1 wherein the oil separator means includes a container having an upper end with an inlet and an outlet, the outlet being connected to the inlet line that extends to the suction inlet of the compressor, the lower end of the outlet being substantially at the upper end of the container and above the expected level of any oil collected in the container so as to reduce the amount of oil flowing with gaseous refrigerant out of the container.

4. In a refrigerant recovery apparatus of the type having inlet means for connecting to a refrigerated air system to withdraw refrigerant from the system, expansion means for converting refrigerant received from the system in liquid phase to a gaseous refrigerant, a compressor having a suction chamber with a suction inlet for receiving the gaseous refrigerant, a condenser for receiving the pressurized gaseous refrigerant and condensing it to a liquid refrigerant, and a storage chamber for storing the liquid refrigerant, the improvement comprising in combination:

high pressure oil separator means mounted to a discharge of the compressor in line with the flow of refrigerant through the apparatus for separating out oil mixed with the refrigerant which has been discharged by the compressor;

a low pressure oil separator connected to the suction chamber of the compressor in line with the flow of refrigerant for removing oil and liquid refrigerant from the refrigerant flowing to the compressor; and the low pressure oil separator including a container with an inlet and an outlet, the outlet of the low pressure oil separator being connected to a line that extends to the suction inlet of the compressor, the outlet of the low pressure oil separator being at a lower elevation than the suction inlet of the compressor for draining oil in the compressor above the suction inlet through the line into the container when the compressor is not operating.

5. The apparatus according to claim 4 wherein the lower end of the outlet of the low pressure oil separator is substantially at the upper end of the container and above the expected level of any oil collected in the container so as to prevent oil from flowing with gaseous refrigerant out of the container.

6. In a refrigerant recovery apparatus of the type having inlet means for connecting to a refrigerated air system to withdraw refrigerant from the system, expansion means for converting any refrigerant received from the system in liquid phase to a gaseous refrigerant, a compressor having a suction chamber with a suction inlet for receiving and pressurizing the gaseous refrigerant, a condenser for receiving the pressurized gaseous refrigerant and condensing it to a liquid refrigerant, and a storage chamber for storing the liquid refrigerant, the improvement comprising in combination:

a high pressure oil separator connected to a discharge outlet of the compressor and to the condenser in line with the flow of refrigerant for separating out oil mixed with the refrigerant which has been discharged by the compressor;

an oil line extending from the high pressure oil separator to the suction chamber of the compressor;

valve means located in the high pressure oil separator for opening the oil line when the level of oil in the high pressure oil separator is above a selected level, causing oil located in the high pressure separator above the selected level to be drawn into the suction chamber of the compressor while the compressor is operating, and for closing the oil line to upward flow when the oil in the high pressure oil separator is below the selected level;

a low pressure oil separator connected to the suction inlet of the suction chamber of the compressor in line with the flow of refrigerant for removing oil and liquid refrigerant from the refrigerant flowing to the compressor, the low pressure oil separator including a container with a top and an inlet and an outlet extending into the top, the outlet of the low pressure oil separator being connected to a line that extends to the suction inlet of the compressor, the outlet of the low pressure oil separator being at a lower elevation than the suction inlet of the compressor for draining oil in the compressor above the suction inlet through the line into the container when the compressor is not operating;

the outlet of the low pressure oil separator having a lower end which is near the upper end of the container and above the expected level of any oil collected in the container so as to reduce the amount of oil flowing with gaseous refrigerant out of the container; and drain means for draining any oil collected in the low pressure oil separator.

7. The apparatus according to claim 6 further comprising:

a hollow annular jacket mounted around the exterior of the storage chamber, the jacket having an inlet connected to the expansion means and an outlet leading to the low pressure separator for receiving gaseous refrigerant from the expansion valve and warming the gaseous refrigerant by heat exchange with liquid refrigerant stored in the storage chamber; and drain means for draining any oil collected in the jacket.

8. The apparatus according to claim 6 further comprising heater means for heating the high pressure oil separator and the low pressure oil separator; and pressure sensor means for sensing the discharge pressure of the compressor and for turning the heater means on if the pressure drops below a selected level.

* * * * *

UNITED STATES PATENT AND TRADEMARK OFFICE

CERTIFICATE OF CORRECTION

PATENT NO. : 5,040,382

DATED : August 20, 1991

INVENTOR(S) : Anthony W. Abraham

It is certified that error appears in the above-identified patent and that said Letters Patent is hereby corrected as shown below:

On the title page, item (73) Assignee, delete "501".

Signed and Sealed this

Twenty-third Day of March, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,040,382

DATED : August 20, 1991

INVENTOR(S) : Anthony W. Abraham

It is certified that error appears in the above-indentified patent and that said Letters Patent is hereby corrected as shown below:

Column 6, line 29, "form" should be --from--.

Signed and Sealed this

Fifteenth Day of June, 1993

*Attest:*

Michael K. Kirk

MICHAEL K. KIRK

*Attesting Officer*

*Acting Commissioner of Patents and Trademarks*